US006056468A

United States Patent [19]

Niewiadomski

[11] Patent Number: 6,056,468

[45] Date of Patent: May 2, 2000

[54] ERASER FOR WHITEBOARD MARKER

[76] Inventor: Mitchell Niewiadomski, 3784 Oak Meadow La., Lowell, Mich. 49331

[21] Appl. No.: 09/165,834

[22] Filed: Oct. 2, 1998

Related U.S. Application Data

[60] Provisional application No. 60/060,746, Oct. 2, 1997.

[51] Int. Cl.[7] ..... B43K 29/00

[52] U.S. Cl. ..... 401/195; 401/52; 401/198

[58] Field of Search ..... 401/195, 52, 196, 401/198; 15/427, 428; D19/36, 53

[56] References Cited

U.S. PATENT DOCUMENTS

| | | | |
|---|---|---|---|
| D. 208,282 | 8/1967 | Speers | D74/7 |
| D. 330,388 | 10/1992 | Choi | D19/36 |
| D. 362,683 | 9/1995 | Wagner et al. | D19/53 |
| D. 369,183 | 4/1996 | Yoshida | D19/49 |
| 447,873 | 3/1891 | Hanimann | 15/427 |
| 1,550,770 | 8/1925 | Akira | 15/427 |
| 1,770,426 | 7/1930 | Paris et al. | 15/427 |
| 4,028,771 | 6/1977 | Lin | 15/434 |
| 4,167,347 | 9/1979 | Hoyle | 401/6 X |
| 4,207,646 | 6/1980 | Osborne | 15/224 |
| 4,393,022 | 7/1983 | Handl | 264/148 |
| 4,578,420 | 3/1986 | Handl | 524/490 |
| 4,817,226 | 4/1989 | Kuo | 15/3.53 |
| 4,937,910 | 7/1990 | Frazier | 15/231 |
| 4,991,985 | 2/1991 | Laipply | 401/117 X |
| 5,072,483 | 12/1991 | Durand | 15/210 R |
| 5,382,562 | 1/1995 | Hutten | 503/227 |
| 5,429,678 | 7/1995 | Fany | 134/6 |
| 5,432,973 | 7/1995 | Wagner et al. | 15/210.1 |
| 5,855,442 | 1/1999 | Keller | 401/195 |
| 5,871,294 | 2/1999 | Turner | 401/52 |

FOREIGN PATENT DOCUMENTS

| | | | |
|---|---|---|---|
| 298500 | 4/1990 | Japan | 401/6 |

*Primary Examiner*—David J. Walczak
*Attorney, Agent, or Firm*—Van Dyke, Gardner, Linn & Burkhart, LLP

[57] ABSTRACT

An eraser for erasing markings on a white board has a body having a pair of arms for engaging a marker and a wiper blade connected to the body and extending therefrom to wipe along a surface of a whiteboard for removing dried ink thereon. The eraser alternatively includes different attachments as well as an embodiment where the wiper blade is made unitary with the marker. The eraser can have differing cross-sections including a longitudinal recess or hollow runner located between the arms and the wiper blade.

26 Claims, 7 Drawing Sheets

ERASER FOR WHITEBOARD MARKER

CROSS REFERENCES

This application claims priority to United States Provisional Patent Application Serial No. 60/060,746, filed Oct. 2, 1997.

BACKGROUND OF THE INVENTION

1. Field of the Invention

The present invention generally relates to an eraser for erasing the markings from a marker, and more particularly, to an eraser for erasing the ink from a dry erase marker.

2. Description of the Prior Art

In recent years, the use of dry erase markers has become increasingly more popular. Most dry erase markers are designed for use on relatively non-porous writing surfaces, such as plastic, mylar, films, porcelain or porcelain-like surfaces and other similar types of surfaces. A very common term used for boards and walls having these types of surfaces is a "whiteboard." For these whiteboards, many types of markers are used for writing thereon. Typically, whiteboard markers have a particular formulation that substantially prevents the ink from permanently adhering to the non-porous writing surface. This ink dries on the surface of the whiteboard leaving a thin film. Previously, the materials used in erasers for erasing the dried ink of a dry erase marker have been similar to conventional chalkboard erasers. The dried film is relatively easily erased with a variety of materials or devices, but most commonly with an eraser made of bristles (many different known types of materials can be used for the bristles), felt, cloth or even the user's finger.

Traditionally, one of the main problems with known erasers is that the eraser is always manufactured separate from the marker itself. As a result, very often the eraser is difficult to locate because it has been carried away or misplaced. Thus, the marker is not available for erasing at the writing surface by the user. In the past, the erasers have also been made of a thread or cloth-like material. These types of erasers commonly create dry erase dust that becomes airborne when shaken or pounded against the writing surface. Additionally, the marker dust can often not be completely removed from the eraser, thus making the erasing process quite messy.

Despite the long time presence of these and other problems with traditional markers, there has been very little development of this type of product. Further there remains a need for an improved dry erase marker that overcomes the above problems.

SUMMARY OF THE INVENTION

The present invention overcomes the prior problems of missing or lost erasers for dry erase markers. In one embodiment, an eraser according to the present invention is made selectively attachable to the body of the marker and is particularly dimensioned to allow for comfortable use of the marker with the eraser attached. In this embodiment, the eraser for the marker includes an elongated wiper blade attached to the marker by way of a pair of semi-rigid, elongated arms or prongs enveloping the marker. By pressing the wiper blade against the writing surface and moving the blade thereon, ink forming written material on the writing surface is cleanly and effectively erased.

In an alternative embodiment, the eraser is integrally formed with the body of the marker. The wiper blade extends generally parallel to the elongated marker body. In various other embodiments, the shape or manner of attaching the eraser to the marker can be varied.

DETAILED DESCRIPTION OF THE PREFERRED EMBODIMENT

Figure 1:
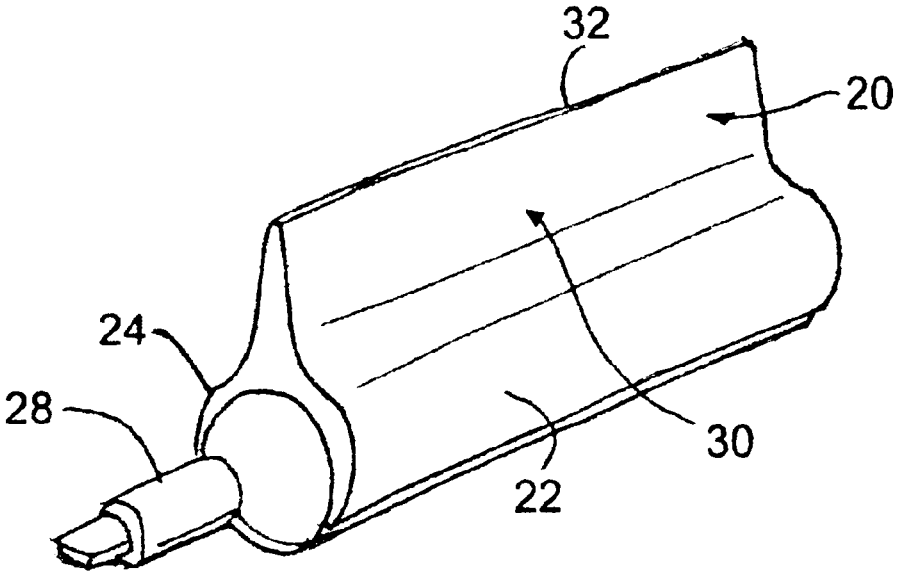
FIG. 1 is a perspective view of a first embodiment of an eraser according to the present invention shown attached to a dry erase marker.

The present invention is described with reference to the accompanying figures wherein reference numerals in the description correspond to like elements in the figures. Referring generally to the figures and in particular to FIGS. 1, 2, 7 and 13, there is shown an eraser 20, according to a first embodiment of the present invention. The eraser 20 preferably includes a pair of elongated arms or prongs 22 and 24 that extend along at least a portion and preferably the entire length of eraser 20. The elongated arms 22 and 24 are preferably semi-rigid, resilient, and elastic in the sense that they are pliable or flexible enough to spread out over the diameter of the marker 28 but are rigid enough to maintain a good grip on the marker 28 such that the marker 28 will not twist, rotate or move on the marker 28 in the preferred embodiment. Elongated arms 22 and 24 define a recess 26 that is shaped generally to conform to the shape of a marker 28. Recess 26 is dimensioned slightly smaller than marker 28 such that when marker 28 is inserted into recess 26, eraser 20 is secured to marker 28. Eraser 20 can, therefore, be selectively attached or detached from marker 28. Arms 22, 24 also form a handle region as a user grips eraser 20 for erasing.

Eraser 20 includes a wiper blade or wiper blade portion 30 attached above the intersection of elongated arms 22, 24. Wiper blade portion 30 defines an erasing edge 32 that is preferably generally straight and continuous along its extent but can be made to have any shape and can be made discontinuous or intermittent. Erasing edge 32 is the portion of eraser 20 that contacts the writing surface and removes markings thereon when eraser 20 is passed over the writing surface. Wiper blade 30 preferably extends a predefined length that is much greater than the width of the wiper blade 30. While the length to width ratio can be as low as 1:1 it is preferably greater than 2:1 and can be as high as 30:1, or higher.

The eraser 20 according to the present invention overcomes the problem of lost or misplaced erasers by attaching to the marker itself in a manner which permits use of the marker when the eraser 20 is attached or in an alternate embodiment, when the eraser is made unitary with the marker. The attachment of eraser 20 to marker 28, therefore, insures the presence of an eraser at all times during the use of marker 28. When marker 28 runs out of ink, eraser 20 can be removed and attached to a fresh marker.

Figure 2:
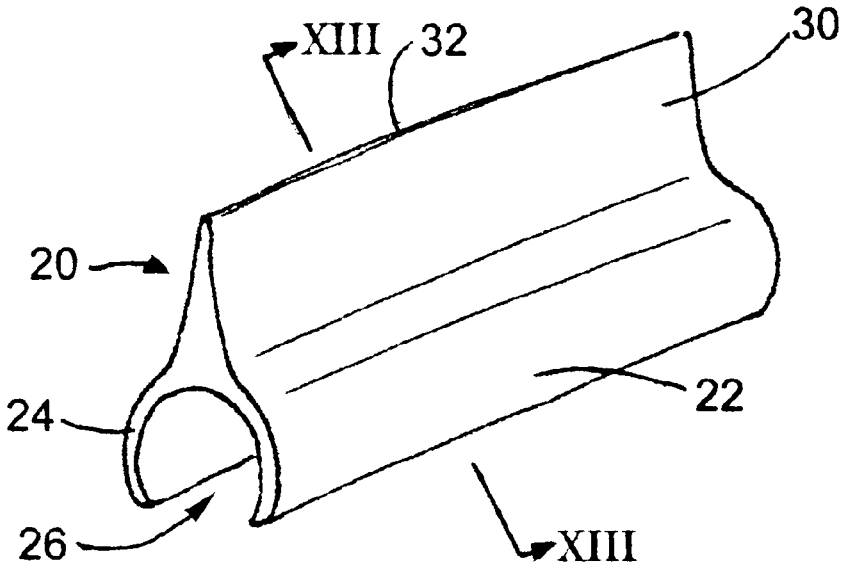
FIG. 2 is a perspective view of the embodiment of FIG. 1 shown with the dry erase marker removed from the eraser.

The elongated length of wiper blade 30 allows the eraser 20 to erase a greater surface area per stroke. In fact, while wiper blade 30 is depicted in FIGS. 1 and 2 as extending for generally the length of marker 28, it is contemplated that eraser 20 could incorporate a wiper blade 30 extending a greater length or shorter length than marker 20.

Eraser 20 can be made from a wide variety of rubbery like materials such as latex, natural rubber, urethane, thermoplastic rubbers, silicone, neoprene, PVC, or the like. Also, fibrous material, such as bristles or felt, could effectively be used in place of rubber material. In the preferred embodiment, the elongated arms 22, 24 are made of a stiffer material than is wiper blade 30. Most preferably, eraser 20 is made of a PVC material with arms 22 having a 1/16 inch thickness, while eraser edge 32 is preferably 1/8 inch thick and protrudes approximately 1/2 to 1 inch above the marker body. The cylindrical inner channel of recess 26 is most preferably 0.700 inches in diameter. All of the dimensions above are considered mere suggestions and as working with most commonly available markers. It should be understood by a person of ordinary skill in the art that the present invention can be made with any standard marker size.

Eraser 20 is preferably made using a co-extrusion process or can alternatively be made using an injection molding process as is well known. However, in the preferred extrusion process, the wiper 30 cannot be made to be an integral or unitary part of a marker's 28 housing. The wiper 30 of the present invention can be made integral or unitary with the housing of the marker 28 using an injection molding process.

Eraser 20 preferably secures to marker 28 with a frictional clamping action, such that a compressive clamping force is exerted against marker 28 and generates a relatively high frictional resistance to sliding eraser 20 longitudinally relative to marker 28 as well as resistance to rotation about the body of marker 28. The resilient elasticity of eraser 20 preferably provides eraser 20 with the ability to be repeatedly removed and resecured to different markers 28. Eraser 20 may therefore be used with different colors and types of markers 28, or with a succession of similar markers 28 as each marker is depleted.

The eraser 20 can be made in any color but is preferably made to have clear or translucent arms or prongs 22, 24 and a natural white and opaque wiper blade 30.

Figure 3:
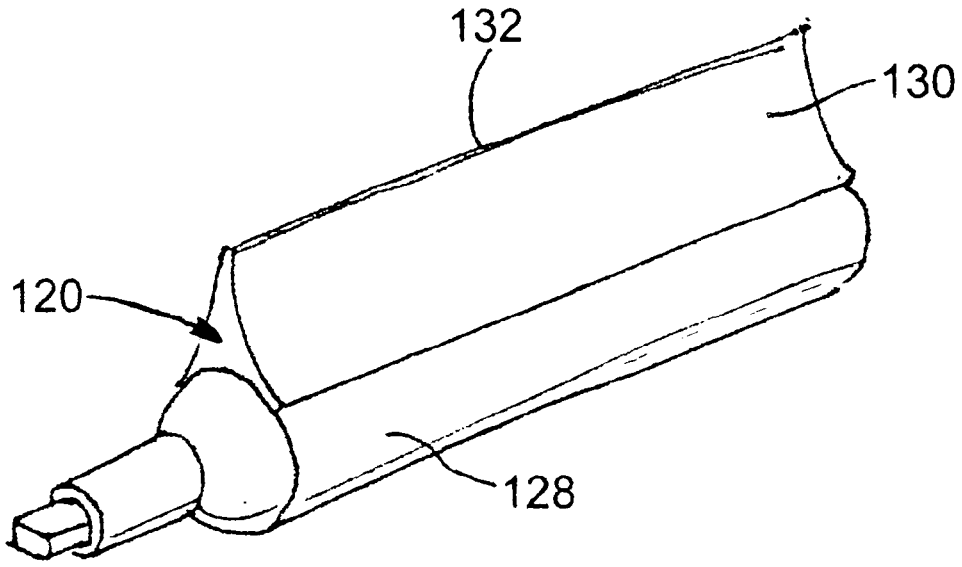
FIG. 3 is a perspective view of a second embodiment of an eraser according to the present invention illustrating the eraser affixed to a dry erase marker.
Figure 4:
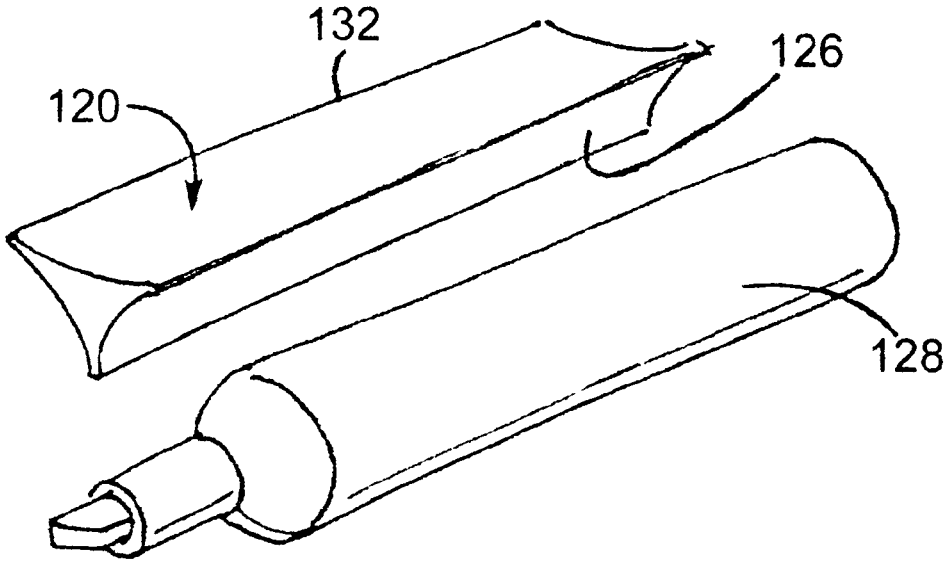
FIG. 4 is a perspective view of the embodiment of FIG. 3 illustrated with the eraser detached from the marker.
Figure 9:
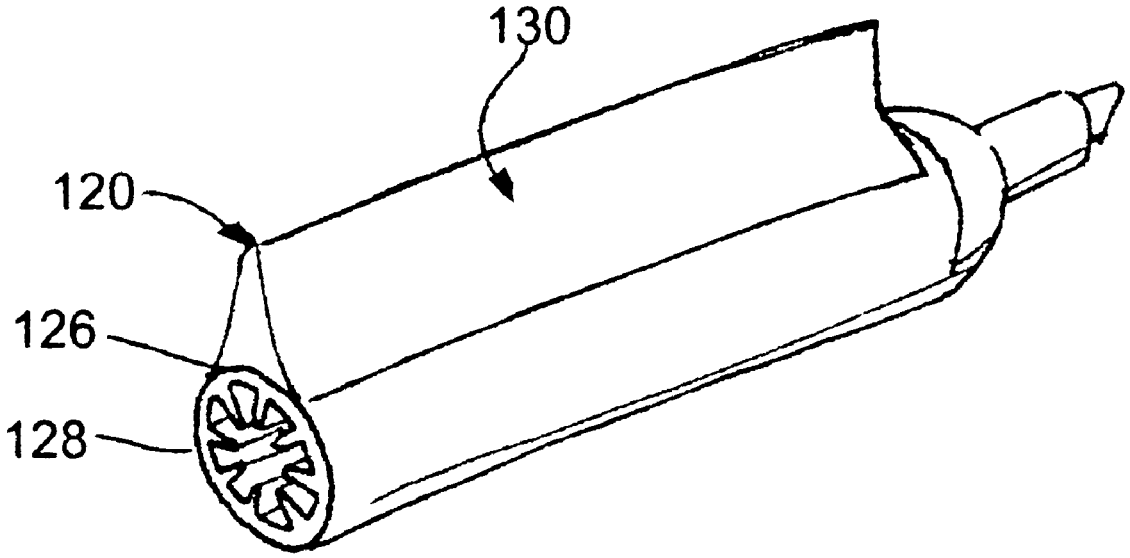
FIG. 9 is a perspective view of the eraser according to the second embodiment of the present invention of FIGS. 3 and 4 further illustrating the eraser attached to the marker.

A second embodiment of an eraser according to one aspect of the present invention is depicted in FIGS. 3–4 and 9 wherein elements corresponding to eraser 20 are renumbered in the hundreds. Eraser 120 in FIGS. 3 and 4 includes a wiper blade 130 but no elongated arms for attaching eraser 120 to marker 128. Instead, eraser 120 includes a curved indentation 126 having a surface generally having the same or similar curvature as the body of marker 128. Eraser 120 is secured to marker 128 by an adhesive applied to the surface of curved indentation 126. The adhesive can be any of a variety of adhesives that bond the eraser to the marker with suitable strength.

Figure 5:
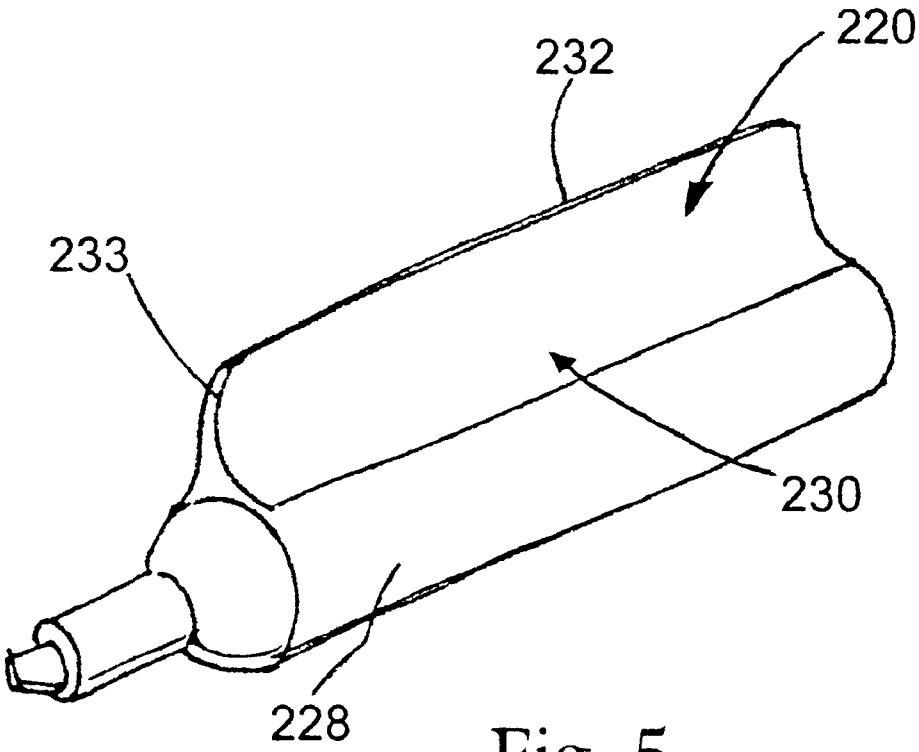
FIG. 5 is a perspective view of a third embodiment of an eraser according to the present invention illustrating the eraser attached to a dry erase marker.
Figure 6:
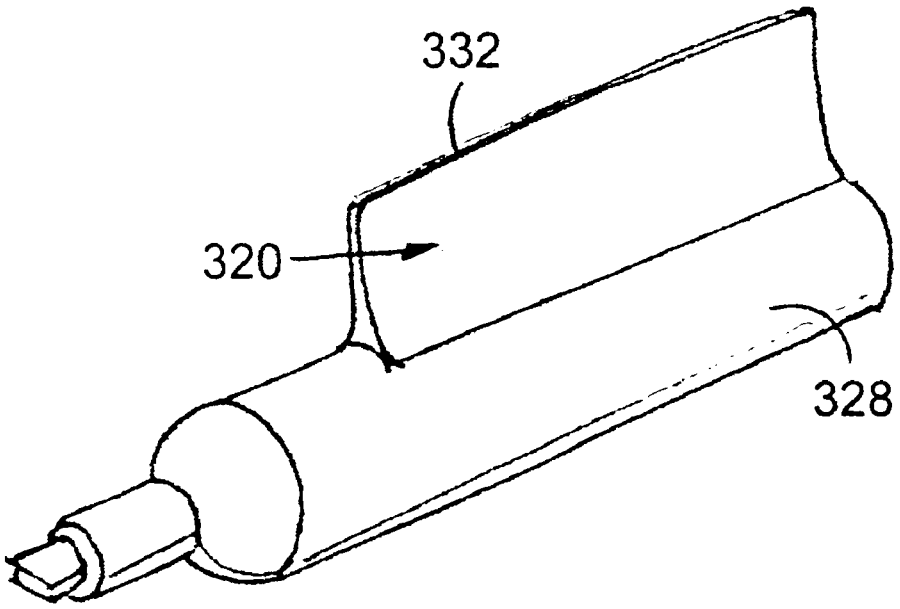
FIG. 6 is a perspective view of a fourth embodiment of an eraser according to the present invention illustrating the eraser attached to a dry erase marker.
Figure 7:
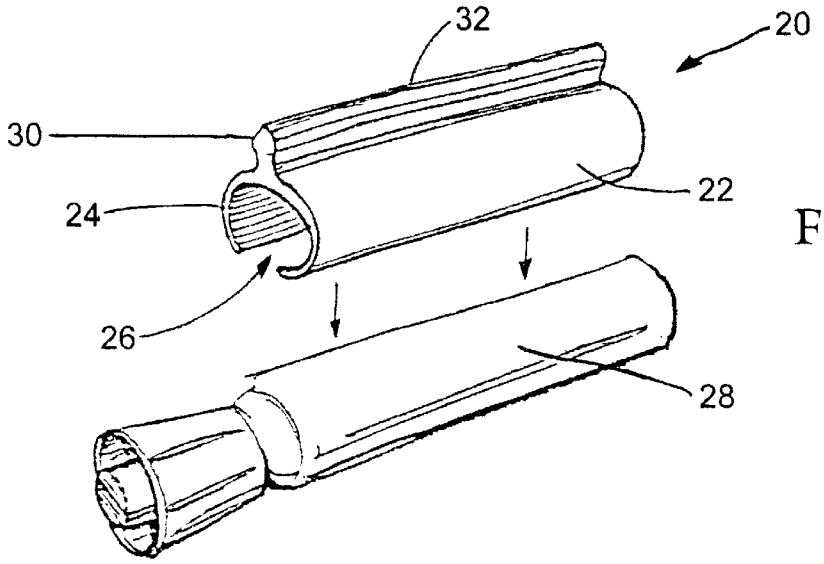
FIG. 7 is a perspective view of the eraser of the first embodiment of the present invention illustrating the attachability of the eraser to a marker.

A third and fourth embodiment of the present invention is depicted in FIGS. 5 and 6, respectively. In FIG. 5, an eraser 220 includes a wiper blade 230 having a rounded comer 233 at the front end of eraser 220. In FIG. 6, eraser 320 extends along the marker for only a fraction of its total length.

Figure 8:
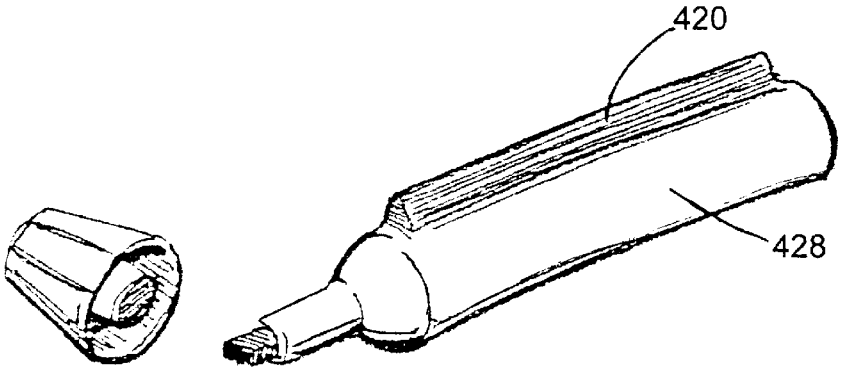
FIG. 8 is a perspective view of a fifth embodiment of an eraser according to the present invention illustrating the eraser being integrally formed as a portion of the marker.

FIG. 8 depicts a fifth embodiment of the present invention. Eraser 420 is integrally molded with the body of marker 428. In this embodiment, eraser 420 is not removable from marker 428.

Figure 10:
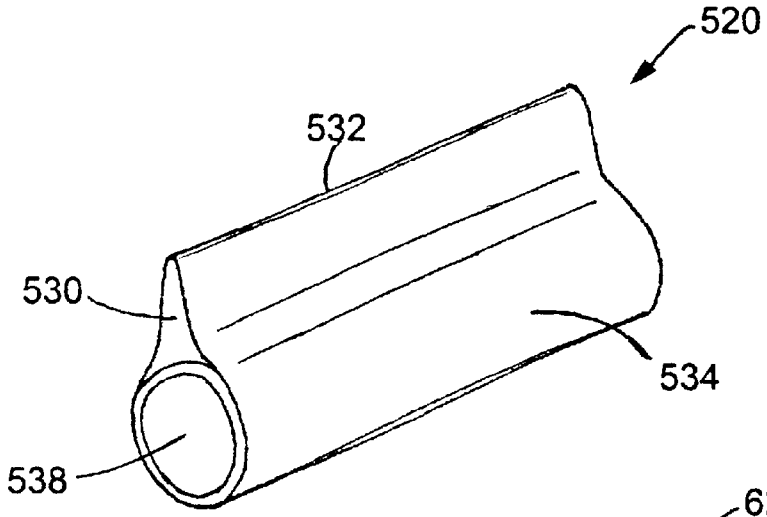
FIG. 10 is a perspective view of a sixth embodiment of the eraser according to the present invention designed for use independent of and/or with a marker.
Figure 11:
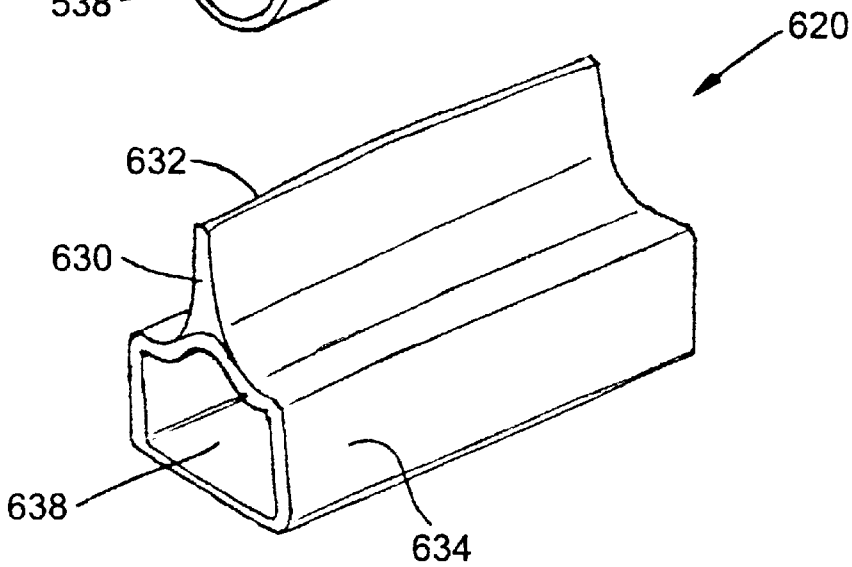
FIG. 11 is a perspective view of a seventh embodiment of an eraser according to the present invention illustrating the eraser designed for use independent of a marker.

A sixth and seventh embodiment of the present invention is depicted in FIGS. 10 and 11. In these embodiments the wiper blade portions 530, 630 are attached to a semi-rigid or rigid substrate 534, 634 of various configurations. The substrates defines an elongated channel 538, 638 extending through the entire length of the eraser. This configuration allows easy use of the wiper blade without being attached to a marker. In eraser 520, substrate 534 is shaped generally cylindrically. In eraser 620, substrate 634 is generally square in cross-section. The size and shape of substrates 534, 634, and blade portion 30 can be such that it is easily handleable, as is the case for standard felt-type erasers currently on the market. It can also be extra large for erasing large areas quickly.

Figure 12:
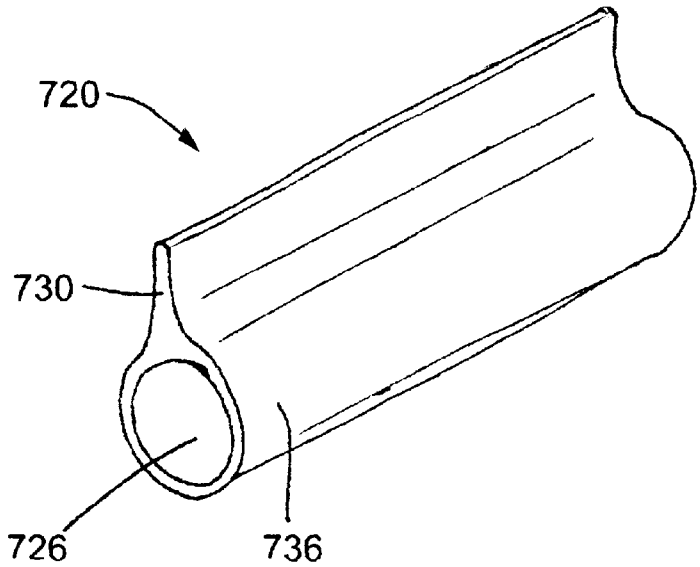
FIG. 12 is a perspective view of an eighth embodiment of an eraser according to the present invention that includes an elastic sleeve for attachment to a marker.
Figure 13:
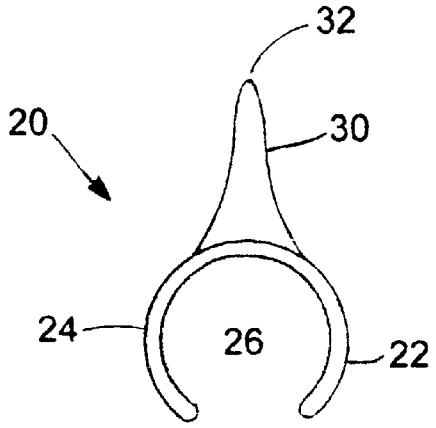
FIG. 13 is a cross-sectional view of the first embodiment taken along the line XIII—XIII of FIG. 2.

An eighth embodiment of the present invention is depicted in FIG. 12. In this embodiment the wiper blade 730 includes an elastic sleeve 736 that extends the entire length of blade 730. The elastic sleeve 736 defines a recess 726 that is shaped generally to conform to the shape of the marker. The recess 726, preferably, is dimensioned slightly smaller than the marker such that when the marker is inserted into recess 726, eraser 720 is secured to the marker. Eraser 720 can, therefore, be selectively attached or detached from the marker in a slip-fit manner.

Figure 14:
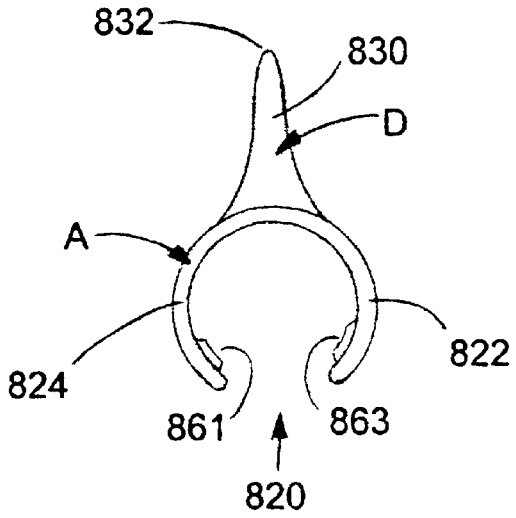
FIG. 14 is a cross-sectional view of a ninth embodiment of an eraser according to the present invention.
Figure 15:
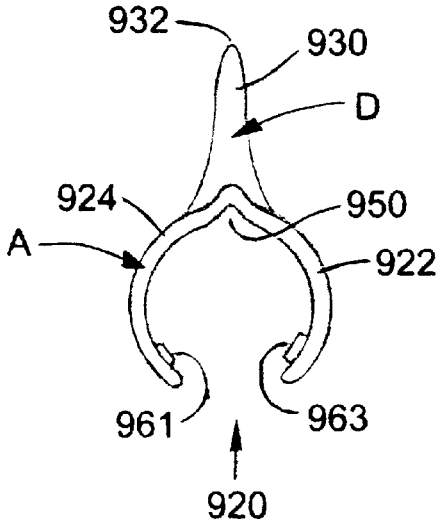
FIG. 15 is a cross-sectional view of a tenth embodiment of an eraser according to the present invention.
Figure 16:
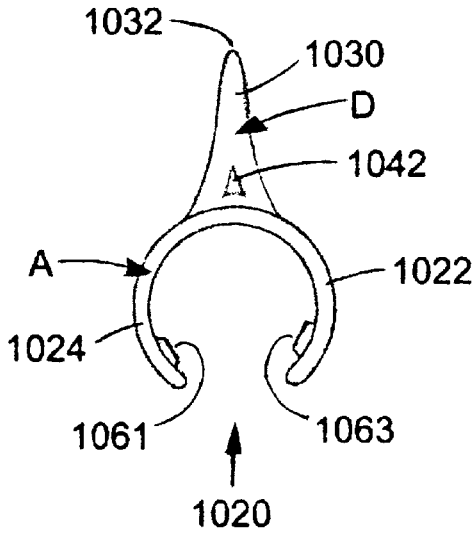
FIG. 16 is a cross-sectional view of an eleventh embodiment of an eraser according to the present invention.

FIGS. 14, 15, and 16 detail cross-sections of a ninth, tenth, and eleventh embodiment of the present invention, respectively. The cross-sections are taken in the same general area line XIII—XIII in FIG. 2. The portions designated A are preferably made of a rigid plastic, while the portions labeled D are preferably made of a flexible, rubber-like material. In FIG. 14, the eraser includes a pair of opposing pads 861 and 863 that help grip eraser 820 to the marker. While the pads 861 and 863 can be made of any appropriate material, it is preferred to use a material that will grip the marker's outer surface and prevent slipping and rotation of the marker with respect to eraser 820. Preferably, the material would be the same material as the wiper blade itself. Pads 861 and 863 are located on arm 822 and 824 at a location such that when eraser 820 is attached to a marker, the longitudinal, center axis of the marker will be between blade 830 and pads 861, 863. Pads 861 and 863 preferably extend for the full length of the eraser.

In FIG. 15, an alternative cross-section shows that at the apex or meeting point of the arms 922 and 924, a recess 950 having an approximate bell shape is defined. The recess 950 improves the manufacturability of the eraser 920 by eliminating mass that adds to warpage during cooling. Further the elimination of such mass reduces the cost of the eraser 920 and can result in a more flexible eraser 920. Preferably the recess 950 extends the entire length of the eraser 920, but can alternately be made to be only a portion of the entire length of eraser 920, or can be made in multiple sections.

FIG. 16 shows a further alternative cross-section wherein a hollow runner 1042 is located between the apex of the arms 1022 and 1024 and the base of the wiper 1030. The hollow runner preferably extends the entire length of eraser 1020 and results in a more manufacturable eraser for the same reasons as stated with respect to the cross section shown in FIG. 15.

While the present invention has been described herein in terms of the preferred embodiments, it will be understood by those skilled in the art that the present invention is not limited to these particular preferred embodiments, but includes any and all such modifications that are within the spirit and scope of the present invention as defined in the appended claims. Examples of such modifications include, but are not limited to: (1) mounting a blade on the back end of the marker in an orientation perpendicular to the washer such that the marker and eraser form a "T" shape; (2) molding an ergonomic wiper blade with contours molded into the rubber for ease and comfort in holding the marker; (3) altering the thickness or height of the blade; and (4) altering the tip 32 of the blade in different configurations, e.g. rounder, square, pointed, multiple blade-lets, etc.

What is claimed is:

1. An eraser for a dry erase marker having an elongated body with a longitudinal central axis, comprising: non-degradable elongated wiper blade adapted to be attached to said marker and adapted to allow use of said marker while said eraser is attached to said marker, said elongated wiper blade generally defining a plane that intersects said central axis when said plane is extended away from said wiper blade.

2. The eraser of claim 1 wherein said wiper blade is integral with said marker.

3. The eraser of claim 1 wherein said wiper blade is selectively detachable from said marker.

4. The eraser of claim 3 wherein said wiper blade is adhesively attached to said marker.

5. The eraser of claim 3 wherein said wiper blade further includes a recessed indentation adapted to partially envelop said marker and thereby attach said eraser to said marker.

6. The eraser of claim 5 wherein said recessed indentation is made of a harder material than said wiper blade.

7. The eraser of claim 3 wherein said wiper blade further includes a cylindrical recess adapted to receive said marker and thereby attach said eraser to said marker.

8. The eraser of claim 6 wherein said cylindrical recess of said eraser is defined by a pair of semi-rigid arms.

9. The eraser of claim 8 further including a pair of opposing pads defined on said pair of semi-rigid arms, said opposing pads adapted to help prevent movement of said eraser on said marker.

10. The eraser of claim 9 wherein said pads are located on said arms at a location wherein a center, longitudinal axis of the marker will be disposed between said wiper blade and said pads when the marker is attached to said eraser.

11. The eraser of claim 8 further comprising a second recess located between each prong of said pair of semi-rigid arms.

12. The eraser according to claim 8 further comprising a hollow runner defined between said wiper blade and said pair of semi-rigid arms.

13. The eraser according to claim 1 wherein said eraser is manufactured using an extrusion process.

14. The eraser according to claim 1 wherein said eraser is manufactured using an injection molding process.

15. An eraser for a dry erase marker which attaches to a body of said marker, comprising:

(a) a pair of semi-rigid, elongated arms which define a recess, said recess dimensioned to selectively receive and maintain said dry erase marker in said recess; and (b) a non-degradable wiper blade attached to said pair of semi-rigid elongated arms, said wiper blade being made of one material of the group consisting of latex, natural rubber, urethane, thermoplastic rubber, silicone, neoprene, and PVC;

(c) said pair of arms and said wiper blade adapted to allow use of said dry erase marker while said eraser is attached.

16. An eraser for a dry erase marker according to claim 15 wherein said eraser further comprises a second recess located between said wiper blade and said pair of semi-rigid, elongated arms.

17. An eraser for a dry erase marker according to claim 15 wherein said eraser further comprises a hollow runner defined between said wiper blade and said pair of semi-rigid, elongated arms.

18. The eraser according to claim 15 wherein said eraser is manufactured using an extrusion process.

19. The eraser according to claim 15 wherein said eraser is manufactured using an injection molding process.

20. The eraser of claim 15 wherein said wiper blade extends for the entire length of the body of the marker.

21. A dry erase marker, comprising:

(a) an elongated marker body having a first and a second end and an elongated middle section defined between said first and second ends, said first end having a marking tip disposed thereat;

(b) an elongated wiper blade integrally molded with said body, said wiper blade extending generally parallel with said elongated marker body, said wiper blade having a generally straight, erasing edge for erasing markings on a marker board, said elongated wiper blade integrally molded to at least a portion of said elongated middle section of said body.

22. The marker of claim 21 wherein said wiper blade extends for an entire length of the body of said marker.

23. An eraser for erasing dry erase markings, comprising:

a non-degradable, elongated wiper blade; and an elongated substrate defining an elongated channel that is dimensioned to receive a dry erase marker and that extends for the length of the wiper blade, said wiper blade attached to said substrate.

24. The eraser of claim 23 wherein said substrate is made of one of a rigid and semi-rigid material.

25. The eraser of claim 23 wherein said substrate is shaped generally cylindrical.

26. The eraser of claim 23 wherein said substrate includes a plurality of flat surfaces joined together.

* * * * *